3/22/88 OR 4,733,244

United States Patent [19]

Edenhofer et al.

[11] Patent Number: 4,733,244

[45] Date of Patent: Mar. 22, 1988

[54] POLARIZATION SEPARATING REFLECTOR, ESPECIALLY FOR MICROWAVE TRANSMITTER AND RECEIVER ANTENNAS

[75] Inventors: Peter Edenhofer; Manfred Galka, both of Bochum; Juergen Habersack, Ottobrunn; Norbert Nathrath, Taufkirchen, all of Fed. Rep. of Germany

[73] Assignee: Messerschmitt-Boelkow-Blohm GmbH, Munich, Fed. Rep. of Germany

[21] Appl. No.: 771,196

[22] Filed: Aug. 30, 1985

[30] Foreign Application Priority Data

Aug. 30, 1984 [DE] Fed. Rep. of Germany ..... 3431986

[51] Int. Cl.[4] ..... H01Q 19/195; H01Q 15/24

[52] U.S. Cl. ..... 343/756; 343/909

[58] Field of Search ..... 343/756, 781 CA, 781 P, 343/872, 909

[56] References Cited

U.S. PATENT DOCUMENTS

| | | | |
|---|---|---|---|
| 3,102,265 | 7/1963 | Moreau et al. | 343/756 |
| 3,137,000 | 6/1964 | Fuller | 343/756 |
| 3,961,333 | 6/1976 | Purinton | 343/872 |
| 4,160,254 | 7/1979 | Frosch et al. | 343/909 |
| 4,228,437 | 10/1980 | Shelton | 343/909 |
| 4,477,815 | 10/1984 | Brunner et al. | 343/872 |

FOREIGN PATENT DOCUMENTS

| | | | |
|---|---|---|---|
| 0015804 | 9/1980 | European Pat. Off. | 343/909 |

*Primary Examiner*—William L. Sikes
*Assistant Examiner*—Doris J. Johnson
*Attorney, Agent, or Firm*—W. G. Fasse; D. H. Kane, Jr.

[57] ABSTRACT

A polarization separating reflector is constructed for use in microwave transmitting antennas or in microwave receiving antennas. The signal supply to the transmitting antennas and the signal retrieval from the receiving antennas may be symmetrical or nonsymmetrical. Such antennas may or may not be equipped with subreflectors. Such antennas have a polarization selectively reflecting lattice structure on or within a dielectric carrier. This antenna structure is resonantly constructed out of separate dipoles having different lengths, preferably in the form of a linear dipole lattice. The dipoles are arranged in a staggered manner, colinearly, or at an angle relative to a reference line, such as the vertical, as desired.

8 Claims, 12 Drawing Figures

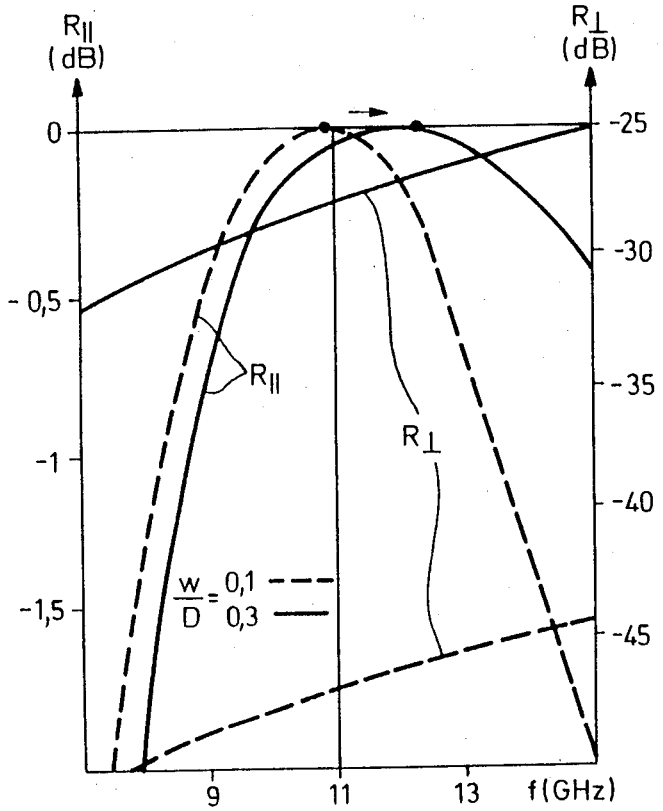
FIG. 3
FIG. 4
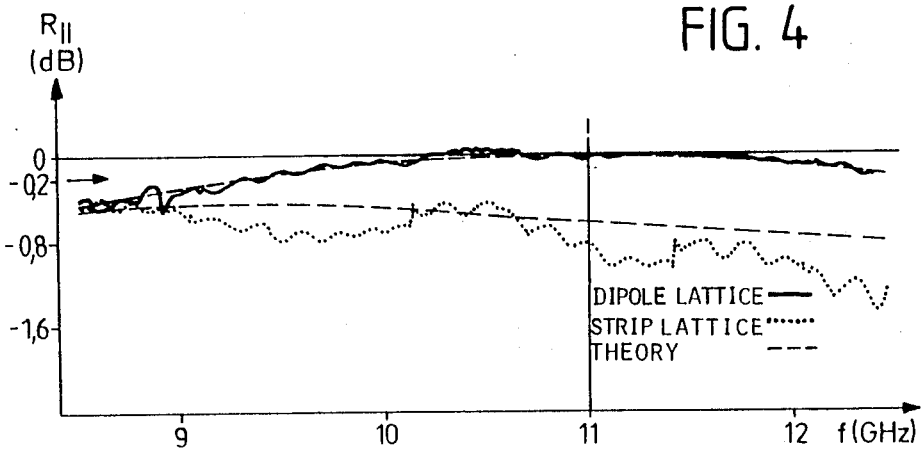

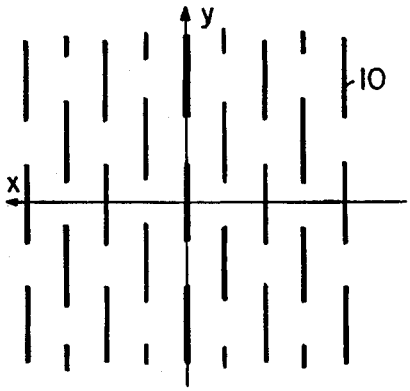
FIG.5
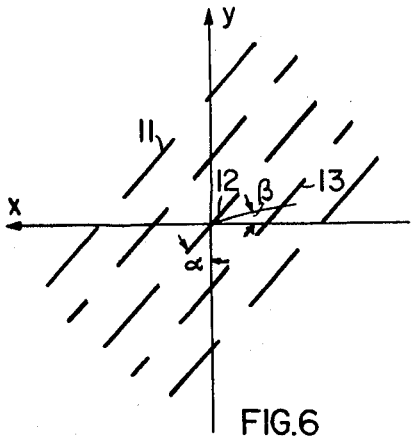
FIG.6
FIG.7
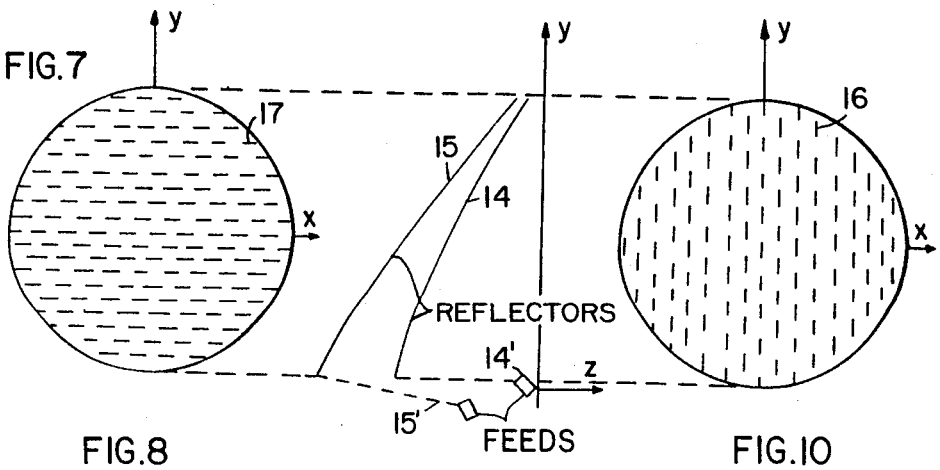
FIG.8
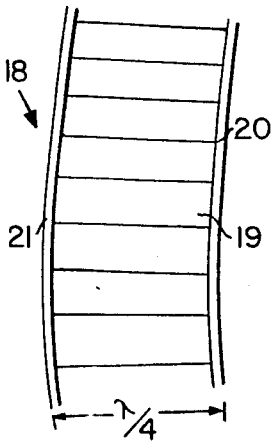
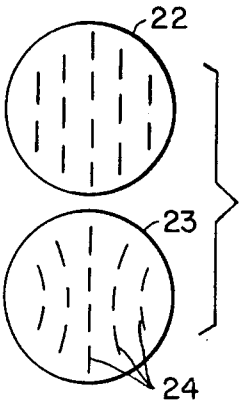
FIG.9
FIG.10
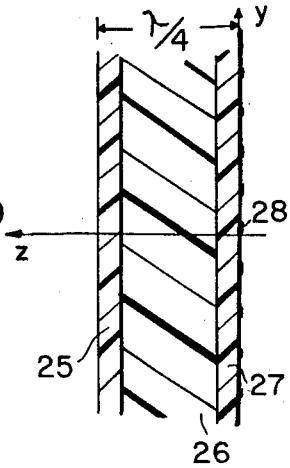

POLARIZATION SEPARATING REFLECTOR, ESPECIALLY FOR MICROWAVE TRANSMITTER AND RECEIVER ANTENNAS

FIELD OF THE INVENTION

The invention relates to a reflector for use in microwave transmitting and receiving antennas. The signal supply to such transmitting antennas and the signal retrieval from such receiving antennas may be symmetric or unsymmetric. Such antennas may be equipped with subreflectors or they may operate without such subreflectors. Antennas of this kind are provided with a polarity selective reflecting lattice structure on or within a dielectric carrier.

DESCRIPTION OF THE PRIOR ART

Communications and telereconnaissance satellites operating in the microwave range almost exclusively employ reflector antennas with single or multiple signal feeding, whereby the development trend is toward ever higher operating frequencies. Such high operating frequencies are made necessary by the desire for an increased band width, for example an up/down signal width of 30/20 GHz, and for using of the satellite for satellite communications, at, for example, 60 GHz with a transmission capacity on the order of Gbit/s. While usually symmetrically excited reflectors with Cassegrain- or Gregory-interceptor reflectors are used for this purpose in ground-based or earth stations, "offset reflector systems", for example as multiple beam antennas for radiating onto specific coverage contours, are becoming increasingly important in on-board or satellite-based stations. However, the advantage of a radiation beam pattern with less interference is overshadowed by the disadvantage, among others, that a cross-polarized signal component occurs near the major lobe and reaches a minor lobe level of typically −20 dB. Such a cross polarized signal component becomes especially interfering when portions of a satellite's path are to be operated with orthogonally polarized signals.

Polarization separating reflectors have become known, for example, from U.S. Pat. No. 4,228,437 (Shelton), wherein dipole lattices in conjunction with dielectric reflectors shall selectively reflect the components of the incident waves and orient the E-vectors thereof parallel to the strip direction. The selection of the spacing between the two orthogonally oriented lattices sets a certain phase relationship between the two reflected field components, which effects a polarity conversion, for example orthogonal linear to circular. However, only a certain limited band width can be achieved through an arrangement of several respectively similarly oriented lattices behind one another.

Furthermore, reflector structures with dipole lattices, for example also cross dipoles, have become known, for instance, from U.S. Pat. No. 4,160,254 (Frosch). These structures are used for frequency selective reflection of similarly polarized signals. Since cross dipoles always reflect both polarization directions, they are only usable for frequency separation, but not for polarization separation.

OBJECTS OF THE INVENTION

In view of the above it is the aim of the invention to achieve the following objects singly or in combination:

to provide a polarization separating reflector which may operate at a high frequency with a wide operational band width without a frequency selectivity effect;

to allow the resonance frequency of such a reflector to be selected by adjusting the dipole length and allow the operating band width to be selected by adjusting the dipole spacing distance; and to reduce in such a reflector the reflection loss of the copolar component so that it does not exceed 0.02 to 0.10 dB, and to reduce the cross polar component in the range of 30 to 40 dB.

SUMMARY OF THE INVENTION

The above objects have been achieved in a polarization separating reflector according to the invention, wherein the reflector has a resonance structure of separate dipoles having a dipole length and a dipole spacing so dimensioned as to achieve an optimal wide band behavior or characteristic. More specifically, a linear dipole lattice is applied to a symmetrically layered, mechanically stiff low-loss dielectric as a carrier, whereby the dipoles of the lattice are arranged in a staggered fashion, or in a colinear fashion or at any desired slant. The dipole lattice may be used in a double reflector arrangement in an orthogonal orientation. The linear dipoles of the dipole lattice may lie on parallel lines in the aperture of the antenna. The dielectric carrier for the resonant lattice may be a sandwich shell with an approximately $\lambda/4$ cover skin spacing.

BRIEF DESCRIPTION OF THE DRAWINGS

In order that the invention may be clearly understood, it will now be described, by way of example, with reference to the accompanying drawings, wherein:

FIG. 3 is a diagram of the frequency characteristic of the reflection coefficients $R_{\parallel}$ and $R_{\perp}$, whereby the relative strip width w/D is used as a parameter;

FIG. 4 is a diagram of a measured frequency characteristic of the magnitude of the reflection coefficient for $R_{\parallel}$ for dipole lattices and for strip lattices;

FIG. 5 shows a linear dipole lattice;

FIG. 6 shows a linear dipole lattice with the dipoles arranged at a slant;

FIG. 7 is a double reflector arrangement;

FIG. 8 is a portion of a curved substrate for carrying the dipoles in a reflector;

FIG. 9 illustrates the projection of the linear dipoles into the plane of the antenna aperture; and FIG. 10 shows a symmetrically layered substrate for a dipole lattice.

DETAILED DESCRIPTION OF PREFERRED EXAMPLE EMBODIMENTS AND OF THE BEST MODE OF THE INVENTION

Figure 1:
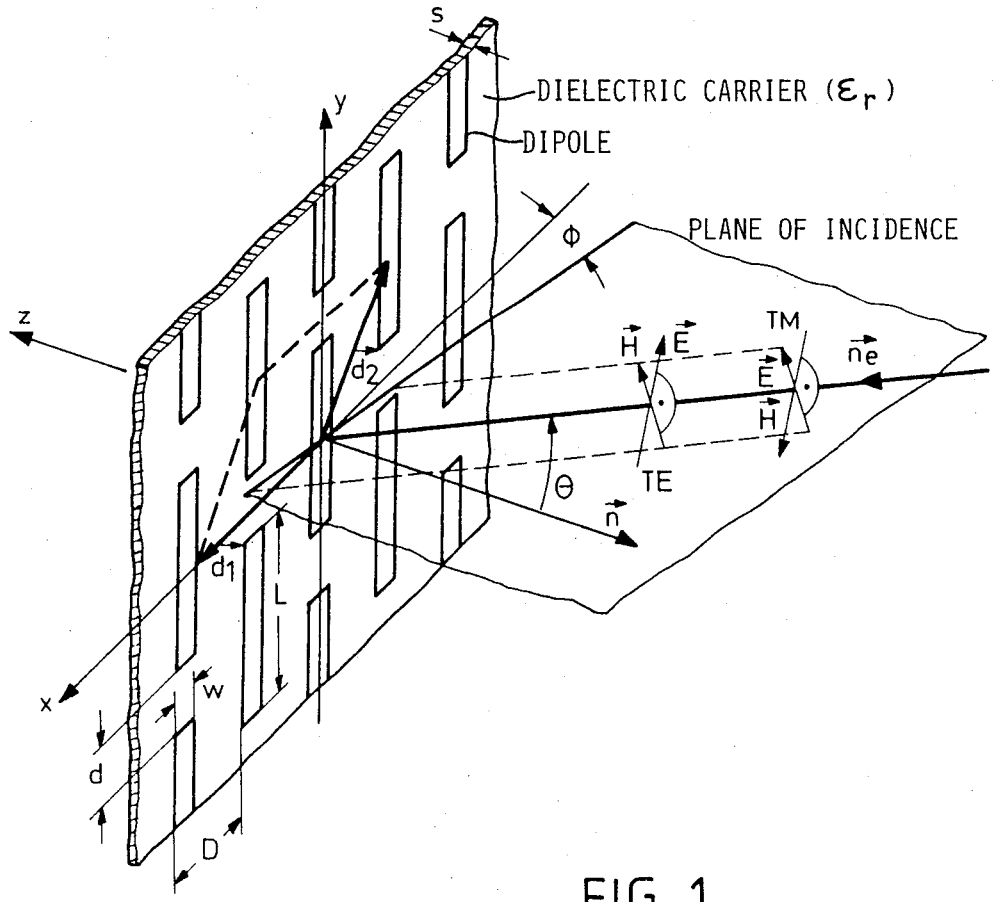
FIG. 1 is a perspective view of an example embodiment of a dipole lattice according to the invention.

In the following the use of a dipole lattice will be described. The dipole lattice is used for improving the polarization separating reflection characteristics of an "offset-reflector-antenna". FIG. 1 shows a two-dimensional dipole array which is impinged upon from the right side by a TE/TM-polarized planar, homogenous wave. For the sake of simplicity, several valid assumptions are made: that the lattice is infinitely large; that the thickness of the metallic strip dipoles may be disregarded; and that the conductivity of the strip dipole is infinite. The lattice parameters are optimized so that in the case of dipole resonance $L \sim \lambda_o/2$ with a sufficiently wide band ratio, the copolar reflection and depolarization losses are minimal and simultaneously a sufficiently strong suppression of the cross-polar field is achieved, for example $\leqq -40$ dB.

In order to determine the current distribution, one may start with a field graph of the Floquet-modes p, q and introduce lattice vectors in the x, y plane and the lattice surface, whereby the total electromagnetic field near the dipole lattice is developed as a solution statement of the vectorial wave function in a double, twice infinite Fourier series. In order to suppress minor lobes in the scatter pattern diagram of the dipole array, the dipole spacings D, d are selected so that $|\vec{d_1}|, |\vec{d_2}| < \lambda_o$ is achieved. Thus, geometric optics remain valid for describing the reflection and transmission process in the remote or distant radiation field.

A defining equation for the desired current distribution $\vec{I}(x, y)$ on the dipoles of the array may be derived from the three spacial ranges of the scatter field and if the continuity conditions for the transversal components of the electric and magnetic field strengths are satisfied at the respective boundary surfaces. Particularly, the resultant transversal component of the incident $p=q=0$ and scattered electrical field must disappear in the lattice plane $z=0$ on the strip dipole.

For $\vec{I}$=transient of the transversal magnetic field, a Fredholmic integral equation of the first order is obtained. This integral equation is independent of the geometric form or shape of the scattering bodies of the planar array.

The numerical solution for the reflection coefficients is derived by the moment method with weighting according to Galerkin. The two-dimensional current distribution may be approximated by the summation statement $$\vec{I}(x, y) = \vec{I_x}(x) + \vec{I_y}(y)$$

and with a development in accordance with orthonormalized basis functions. These simplifying approximations may be assumed to be meaningful in view of the basic assumptions $L \sim \lambda_o/2 > D > w$, especially since in the present case with reflection and transmission coefficients of the array, only distant field magnitudes are of interest.

Furthermore, to insure that only Floquet-modes $p=q=0$ may propagate in the distant or remote field, the condition $D>d$ must be valid. Thus, in formulating the basic or basis functions it may be avoided that an additional "edge-mode" must be taken into account. This edge-mode primarily pertains to the cross current $\vec{I_x}$. The integral evaluations are simplified in this case, and the integral equation may thereby be transformed into a matrix form, $Zc=A$, wherein Z is the $N \times N$ impedance matrix, c gives the development coefficients, and A is the excitation vector of the incident field. In order to determine the coefficients of the reflection matrix R of the dipole lattice, the total back scattered electric field is related to the incident field. All the integral expressions occurring during the numerical calculation, are analytically representable by the trigonometric basic or basis functions.

As expected, the number of sine and cosine basis functions necessary for the distant or remote field determination has proved to be non-critical, $U=3$; $V=6$ is valid as an optimal determination, whereas the number of Floquet-modes for $M \gtrsim 30$ for the TE-polarization and for $M \gtrsim 40$ for the TM-polarization (Brewster-angle) must be chosen relatively high.

Figure 2A:
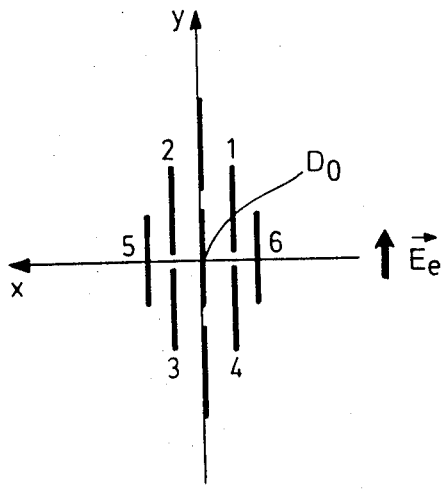
FIG. 2*a* is a schematic view of the basic structure of a dipole lattice according to FIG. 1 with a reference dipole $D_o$ for lateral and axial coupling.

Beginning with a single dipole $D_o$ of the lattice as shown in FIG. 2*a* (TE-incidence, $\phi=0$), the existence of parasitic or radiation coupling in the lattice plane with respect to the four laterally displaced dipoles 1 to 4 with spacing D, is to be assumed primarily, whereas the radiation coupling with respect to the two axially displaced dipoles may be considered to be minimal. Nodes of the lengthwise component $I_y$ of the current distribution exist at the spacing d. The radiation or parasitic coupling with respect to the laterally displaced dipoles 5, 6 each at a distance 2D is surely less pronounced, since the dipoles 5, 6 are "shielded" by the dipoles 2, 3 and/or 1, 4. Due to the staggered displaced radiator arrangement, for example, the upper current node of $D_o$ lies near the current antinodes of the dipoles 1, 2, in fact, with the same phase or in phase with respect to $D_o$. The superposition of these radiation coupled fields leads to an accentuation of the current distribution $\vec{I_y}$ in a direction toward the dipole ends of $D_o$, that is to say, the current nodes are "filled up" by the neighboring current antinodes. The current distribution calculated for the TE-polarization ($\phi=0°$) and the perpendicular incidence for a typical dipole lattice, without a dielectric, confirm this observation quantitatively. Hereby, the cross current $\vec{I_x}$ becomes zero, and furthermore, no unsymmetric distribution functions arise and the superposition of the symmetric cos-form distribution functions achieves a resultant current distribution accentuated or lifted toward the edges, as is clearly shown in FIG. 2*b*.

Figure 2B:
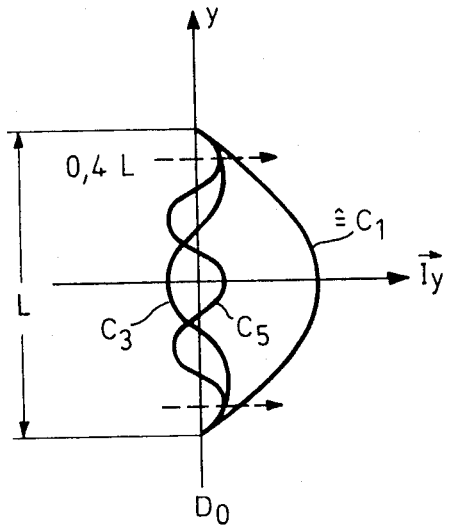
FIG. 2*b* is a schematic diagram of the current distribution $\vec{I}_y(y)$ with accentuation at the dipole ends.
Figure 2C:
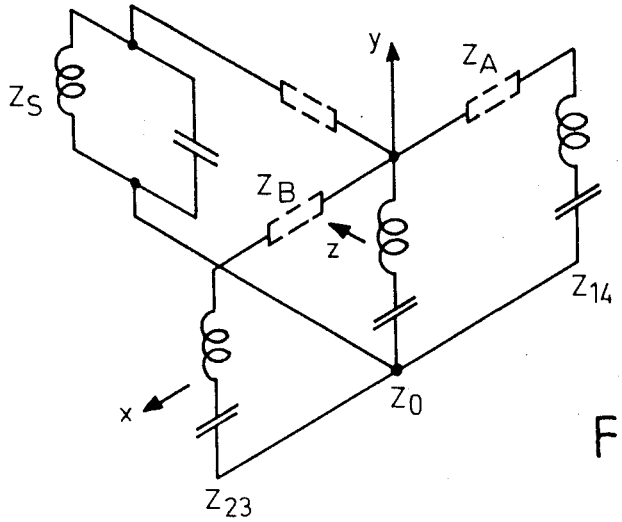
FIG. 2*c* is a schematic circuit diagram of the dipole array as a network of series resonance circuits coupled by parasitic or radiation coupling.

The circuit diagram shown in FIG. 2*c* may thus be derived for an at least qualitative valuation of the radiation coupling. The dipole to be driven at resonance at $\lambda/2$ is combined as a series resonance circuit $Z_0$ with the coupling impedances $Z_{A,B}$ which are radiation conditioned and which result in the lattice plane and normal to the lattice plane, in connection with the sandwich acting as a parallel resonance circuit $Z_s$. An inductive or capacitive reactive or idle component is to be expected for $Z_{A,B}$ dependent upon the dipole spacing distance D. Finally, the series resonance circuits $Z_{14}$ and $Z_{23}$ corresponding to the dipoles 1 and 4, and 2 and 3 respectively, are each connected in parallel as a result of the radiation or parasitic coupling. Even a field theoretic analysis can determine the mode dependent parameters of such a network. If one makes a comparison with a strip or wire lattice, then the series resonance circuit in a dual arrangement shown in the circuit diagram of FIG. 2*c* is to be replaced by an inductance or capacitance depending upon whether the incident electric field is polarized, parallel, or perpendicular to the lattice.

A symmetrically layered, mechanically stiff, low-loss dielectric is used as the carrier material for the lattice, in order to ensure, among other things, a minimal reflection for the cross-polarized signal component. The sandwich light-construction method is suggested heretofore. The fields reflected respectively from the front and rear sandwich cover skins, for example Kevlar, with a selected spacing of $\lambda/4$ superimpose each other in phase-opposition and thereby achieve a reflection minima of $-40$ to $-50$ dB, dependent upon the polarization, frequency, and on the angle of incidence.

In the following the influence of geometric and material parameters on the reflection behavior of the dipole lattice according to FIG. 1 is described and compared with a conventional strip lattice. First, a lattice without a dielectric with a perpendicular incidence ($\theta=\phi=0°$) is described. In the use of a polarization separating "offset-reflector-antenna" the optimization is carried out stepwise in a simplified procedure, and the minimal reflection and depolarization losses of the copolar components and the maximal suppression of the cross polar signal components are determined. The specifications required for communication satellites are, for example, $R_{cop} \geqq -0.2$ dB and $R_{xpol} \leqq -40$ dB. The signal frequency shall be 11 GHz and the desired bandwidth approximately 10% of the signal frequency. With reference to the dipole length L, the following starting reference values are given: $D=2d=6.8$ mm$>\lambda_o/4$; $w=1$ mm. The copolar reflection factor $|R_{195}|=R_{\parallel}$, TE=electric field polarized parallel to the lattice, calculated for the dipole lattice has its maximum value at $L^*=15.6$ mm$>\lambda_o/2$, that is, at a value that exceeds the corresponding free space value of the resonant length by approximately 15%. This increase of the resonant length, compared to a single dipole in series resonance, is caused by the effects of the characteristic radiation or parasitic coupling, whereas the consideration of the finite strip width "w" in the resonance case leads to a shortening of the dipole length.

The radiation or parasitic coupling with respect to the dipoles laterally displaced in the lattice plane, causes an accentuation of the electrical effective dipole length, also in the resonant case. Hereby, $L^*$=constant is now applied. With regard to the axial dipole spacing d it is to be noted that calculations show that the variations in the range of $\lambda_o/128 \lesssim d \lesssim \lambda_o/8$, do not have any substantial effect on the resonance $R_{\parallel} \sim 1$ and all further observations are made with $d=\lambda_o/16=1.7$ mm. The parameter "d" is not critical, since the radiation coupling in the direction of the dipole length axes is minimal. However, the lateral dipole spacing distance D as a lattice parameter is extraordinarily sensitive to the effects of radiation or parasitic coupling. It has been shown, as expected, that with smaller dipole spacing distances, $R_{\perp}$ increases by approximately 6 dB and the maximum of $R_{\parallel}$ is shifted to a higher frequency by approximately 1 GHz. The bandwidth $\Delta f$ is thereby considerably increased.

As shown in FIGS. 2*a* to 2*c*, the laterally displaced dipoles acting as a series resonance loop become ever increasingly inductively radiation coupled with larger packing densities of the lattice. Packing density is defined as the number of dipoles per unit area. The dipole $D_o$ together with the dipoles 1 to 4 act approximately like a two-loop inductively coupled band stop filter in which the resonance frequency $f_r$ as well as the band width $\Delta f$ are increased through stronger coupling. For this purpose, the lattice configuration would be dual with a band pass or transmission behavior provided by coupled full wave dipoles with parallel resonance.

FIG. 3 shows the reflection characteristic for the optimally selected distance $D/\lambda_o=0.2$. The phase curve clearly exhibits the series resonance effect of the dipole lattice. A capacitive or inductive behavior is exhibited for f $f_r$ with a respectively leading or trailing magnetic field and with resonance at 180°. While wider strip dipoles are less sensitive to production tolerances and mechanical as well as thermal tensions, etc., they lead to a serious increase of the electric field $R_{\perp}$ incident perpendicularly to the lattice, as well as of the field $R_{\parallel}$ leading to an increase of $f_r$ and $\Delta f$. The strip width "w" here has the dimension $w=0.55$ mm ($w/D=0.1$). A technological limit is given by $w \gtrsim 0.5$ mm.

Summarizing, it has been shown, that for lattice dimensioning, L and D essentially affect the reflection parallel to the lattice, corresponding to the copolar TE-field components, whereas "w" is determining for the TM-polarization orthogonal thereto, cross polar magnetic field component. An at least approximately optimal dimensioning of the lattice parameters is thereby simplified in that only a weak coupling exists between D, w and d with regard to the reflection behavior. This is attributable, among other things, to the resonance effect of the lattice which allows a substantially isolated determination of the dipole length L. Nonetheless, a wide band reflection can be achieved for $R_{\parallel}$ with only slightly increased $R_{\perp}$ by a lattice chosen to be sufficiently narrow. This wide band behavior is in agreement with the coupling of two circuit band stops or two circuit band pass filters. The thin strip dipoles necessary for a high polarization separation hardly affect $\Delta f$, and in all cases $R_{\perp}$ increases with an increasing frequency.

In comparing the lattice of the invention with lattices of conventional construction, such as strip or wire lattices, it is first to be noted that copolar fields, corresponding to $R_{\parallel}$, may be reflected by the present dipole lattice over broad surfaces with practically no degradation. As further shown by calculations, the present dipole lattice has, on average, an approximately 2 dB improved cross-polar suppression in the frequency range of interest, compared to a conventional strip lattice with the same lattice parameters w, D. Thus as shown in FIG. 3, through the use of a dipole lattice, the parameter "w" may be pushed to the technically realizable limit, and a suppression of $R_{\perp}=-47$ db may be achieved with $D/\lambda_o=0.2$.

In order to achieve such a high cross polar suppression with a comparable conventional strip lattice, then $R_{\parallel}$ would have to be set at the unacceptable value of 1.8 dB. In order to allow not more than $-0.2$ dB with a strip lattice, the strip spacing distance must be reduced to one quarter, namely $D=1.4$ mm. This entails further technological problems, unless broader strips are used having a quite noticeably increased R. In general, it may be said that a dipole lattice achieves at least a 5 dB improved polarization separation.

FIG. 4 shows the results of a hollow conductor simulation measurement in the X-band, in order to represent the reflection behavior of a dipole lattice graphically according to experimental observations. A simultaneous comparison with additional measurements made by the same procedure for a conventional strip lattice is also represented in FIG. 4, whereby the parameters "w", D are respectively the same for both lattices. It can be seen from the full line curve that the present dipole lattice dimensioned to have its mid-band point at 11 GHz, reflects even in a wide band manner practically without reflection- and depolarization-losses. As shown, the $R_{\parallel}$ full line curve first falls below the level of $-0.2$ dB at frequencies lower than approximately 9.3 GHz or at frequencies above 12.4 GHz, which corresponds to a relative band width of approximately 30% of the mid-band frequency. Thus, it has been proved that the experimental results agree with the theoretical results.

The above described solution of the objects of the invention thereby entails three essential advantages: first that the resonance frequency may be adjusted or selected through selection of the dipole length L; second that the band width is selectable or adjustable through the spacing distance d, D and may in fact be adjusted for a wide band or a selective response; and third that $R_{xpol}$ is determined by the width "w" and is in fact approximately −47 dB at a technical limit of $w_{min} \sim 0.5$ mm.

In the light of the foregoing disclosure, the critical dimensions for a dipole array of an antenna reflector operating at a central wavelength λ as disclosed herein should be within the following ranges or values. The strip or dipole length L should be about λ/2. The strip or dipole width w should be within the range of 0.5 mm $\leqq w << L$. The longitudinal or axial dipole spacing or first spacing d should be within the range of $\lambda/128 \leqq d \lesssim \lambda/8$. The lateral dipole spacing or second spacing D should be about $D \leqq 80/5$. Arrays with dimensions in these ranges or at these values provide optimal broadband antenna characteristics.

In FIG. 5 all the dipoles 10 form a linear lattice in the plane defined by the x and y directions in a three-dimensional rectangular coordinate system in which the z-direction extends perpendicularly to the plane of the drawing.

FIG. 6 illustrates a linear dipole lattice in which the individual dipoles 11 are slanted at an angle α relative to the y-direction. An angle β is enclosed between the x-direction and a line interconnecting the centers of two neighboring dipoles 12 and 13. Both angles α and β may be selected at random or in any desired manner.

FIG. 7 shows schematically portions of two reflectors 14 and 15 one nested in the other and each having its own feeding device 14', 15'. The two reflectors 14, 15 from a double reflector arrangement in which the dipoles 16 of the reflector 14 are arranged orthogonally relative to the dipoles 17 of the reflector 15. The dipoles 16 and 17 are illustrated as being projected into the plane defined by the aperture of the respective reflector 14 or 15.

FIG. 8 shows a broken away portion of a multilayer substrate 18 for a reflector shell carrying the dipoles, not shown, but arranged as disclosed. A honeycomb structure 19 is sandwiched between two cover sheets or skins 20 and 21 which are spaced from each other by a spacing corresponding to about λ/4 of the central operating wavelength λ of the reflector.

In FIG. 9 the plane 22 in the plane of the drawing sheet is defined by the antenna aperture of a curved reflector 23. The dipoles 24 are arranged on the curved surface of the reflector 23 along such lines or curves that the projection of the dipoles into the antenna aperture plane results in parallel lines or columns of dipoles. In other words, the dipoles are optically located on parallel lines in the aperture plane of the reflector. This is accomplished by placing the individual dipoles on the reflector curvature toward the reflector edge in a distorted manner to such an extent that optically parallel lines are achieved in the antenna aperture plane.

FIG. 10 shows a reflector substrate, for example of fiber composite material forming a low loss dielectric comprising a plurality of symmetrically arranged layers 25, 26, 27. The outer cover layers 25, 27 are spaced preferably at λ/4 and are symmetrical relative to a plane centrally through the central layer 26 which may be a honeycomb structure. The dipoles 28 are secured to the surface of the layer 27, for example, by a suitable adhesive or as the result of the curing of the resin matrix of the fiber composite material.

Although the invention has been described with reference to specific example embodiments, it is to be understood, that it is intended to cover all modifications and equivalents within the scope of the appended claims.

We claim:

1. An antenna reflector system for a microwave transmitter antenna or for a microwave receiver antenna, comprising a plurality of low-loss dielectric layers arranged symmetrically to form a substrate, a plurality of individual dipoles arranged in a resonance pattern to form a single dipole lattice or array on said substrate which forms a mechanically stiff carrier for said dipoles, all of said dipoles having substantially the same given dipole length (L) and substantially the same resonant frequency, a first spacing (d) between neighboring dipoles in the direction of said dipole length, each dipole having a given dipole width (w), a second spacing (D) between neighboring dipoles in the direction of said dipole width, said dipole length (L) and said first (d) and second (D) spacings being so selected that an optimal broadband antenna characteristic is achieved, said dipoles being arranged in columns which are displaced relative to each other so that dipoles of one column fully overlap said first spacing (d) between the dipoles of another neighboring column and vice versa for forming polarization separators which together achieve said broadband antenna characteristic.

2. The antenna reflector system of claim 1, wherein the dipoles in each column are longitudinally aligned with one another in a colinear arrangement.

3. The antenna reflector system of claim 1, wherein the dipoles are arranged at an angle slanting relative to a vertical reference line.

4. The antenna reflector system of claim 1, wherein said single dipole lattice is arranged with another single dipole lattice to form a double reflector having two reflector sections arranged orthogonally relative to each other.

5. The antenna reflector system of claim 1, wherein said dipoles are linear dipoles arranged to form a single linear lattice, said reflector having a given surface curvature and an antenna aperture defining a plane, said linear dipoles being located on curves of said curvature which curves constitute parallel lines when projected into said antenna aperture plane.

6. The antenna reflector system of claim 1, wherein said substrate of dielectric material forms a sandwich type shell having a cover skin and a cover skin spacing corresponding to about λ/4, wherein λ is the wave length of the respective microwave.

7. The antenna reflector system of claim 1, wherein said plurality of dipoles are arranged to form a single linear dipole lattice.

8. The antenna reflector system of claim 1, operating at a central wavelength of λ, wherein said dipole length L is about λ/2, wherein said dipole width w is within the range of 0.5 mm $\leqq w << L$, wherein said first spacing d is within the range $\lambda/128 \lesssim d \lesssim \lambda/8$, and wherein said second spacing D is about $D \leqq \lambda/5$.

* * * * *